US006024656A

United States Patent [19]

Lane

[11] Patent Number: 6,024,656

[45] Date of Patent: Feb. 15, 2000

[54] GOLF SWING TRAINING METHOD

[76] Inventor: Joseph Lane, 29 Silver Spring Park, Ridgefield, Conn. 06877

[21] Appl. No.: 08/947,177

[22] Filed: Oct. 8, 1997

[51] Int. Cl.[7] ..... A63B 69/36

[52] U.S. Cl. ..... 473/409; 473/271; 473/277

[58] Field of Search ..... 473/266–276, 473/277, 409, 229, 257–265; 273/187 R–189 A

[56] References Cited

U.S. PATENT DOCUMENTS

| | | | |
|---|---|---|---|
| 2,777,697 | 1/1957 | Crossot | 473/218 |
| 3,550,946 | 12/1970 | Menendez | 473/218 |
| 3,638,950 | 2/1972 | Hyotlaine | 473/271 |
| 4,651,994 | 3/1987 | Lee | 473/271 |
| 4,659,084 | 4/1987 | Vuick | 273/183 B |
| 5,022,647 | 6/1991 | Fulcher | 473/229 X |
| 5,048,836 | 9/1991 | Bellagamba | 273/183 B |
| 5,050,885 | 9/1991 | Ballard et al. | 273/183 B |
| 5,188,365 | 2/1993 | Picard | 273/189 R |
| 5,188,366 | 2/1993 | Dorotinsky et al. | 273/188 R |
| 5,209,482 | 5/1993 | Hopfer | 273/187.2 |
| 5,288,074 | 2/1994 | Scheurer | 273/188 R |
| 5,303,927 | 4/1994 | Perry et al. | 273/188 R |
| 5,308,074 | 5/1994 | Dorotinsky et al. | 273/188 R |
| 5,334,028 | 8/1994 | Melligan | 473/266 X |
| 5,456,470 | 10/1995 | Scheurer | 273/188 R |
| 5,513,842 | 5/1996 | Fuss | 473/263 |
| 5,591,090 | 1/1997 | Kauffman | 473/271 |

OTHER PUBLICATIONS

"The American Heritage Dictionary," Second College Edition, 1982 p. 1344 relied upon.

*Primary Examiner*—George J. Marlo
*Attorney, Agent, or Firm*—St. Onge Steward Johnston & Reens LLC

[57] ABSTRACT

A simple, lightweight, portable golf swing training device to fix the rear knee of a golfer in the correct position at setup and to restrict its lateral movement away from the target during backswing, with no interference of the forward movement of the knee, hips or body during the downswing, impact or follow through. The device comprises a base unit with a vertical rod, which has a height that extends at least to the rear knee, affixed thereto. A golfer uses the device by positioning his rear foot on the base rearwardly of the vertical rod and his rear knee forwardly of the vertical rod. By restricting the knee's freedom to over rotate or slide laterally away from the target or collapse away from the target line; the golfer's hips are prevented from either over rotating and/or sliding laterally away from the target. A video camera may be used to videotape a golfer before and during the use of the golf swing training device to compare knee positions.

2 Claims, 2 Drawing Sheets

GOLF SWING TRAINING METHOD

This invention relates generally to golf equipment and in particular to a golf backswing practice device and method to train a golfer to hold his rear knee stable throughout the backswing and thereby restrict over rotation of the hips and/or lateral slide of the hips away from the target.

BACKGROUND OF THE INVENTION

Golfers are constantly seeking to improve their swing technique to improve control, maximize distance and increase consistency. A common mistake is excessive hip rotation and/or lateral slide away from the intended target. Generally lateral slide and over-rotation come as a pair. Over-rotation and lateral slide typically cause a loss in power and inconsistency in the golf shot.

A common cause of over-rotation is incorrect positioning and control of the rear knee. In right handed hitters, the right knee is the rear knee in a normal driving stance; in left handed hitters, the left knee is the rear knee in a normal driving stance. A common problem is the movement of the rear knee further rearwardly, beyond an imaginary line extending upwardly from the rear foot. Another problem is the loss of the correct knee flex during the swing, in which the hitter allows the rear leg to turn too far to the rear.

Often this incorrect process begins with the knee nor properly placed or not having the correct flex at the setup position. When the knee is held in the proper position throughout the backswing, the golfer achieves a stable lower body that encourages both a powerful and consistent downswing.

DESCRIPTION OF THE PRIOR ART

Many devices have been designed to address excessive hip rotation and slide. Such devices, as disclosed for example in U.S. Pat. No. 5,188,396, U.S. Pat. No. 5,188,366, U.S. Pat. No. 5,209,482, U.S. Pat. No. 5,288,074, U.S. Pat. No. 5,303,927, U.S. Pat. No. 5,308,074 and U.S. Pat. No. 5,456,470, attempt to control the hips directly without addressing placing the knee in the proper position at setup and keeping the knee in the proper position throughout the backswing. Such devices are not completely effective to maximize the golfer's performance. While some of the devices disclosed in the patents listed above are portable, others are either not practicably portable and/or require a setup that would restrict their use in many locations and/or take excessive time to setup and use for practice. Some of these devices cannot be used indoors and others require being on a natural earth surface to permit some portion of the device to be driven into the ground to stabilize the device or some portion of the device. None of those cited immediately above in any way address or deal effectively with control of the knee.

Another device, disclosed in U.S. Pat. No. 5,334,028, is adapted to train a golfer to move both knees together in fixed relationship in an effort to improve the golfer's swing.

Another device, disclosed in U.S. Pat. No. 4,659,084, provides control of the head, and a zone of movement for the golfer's knees between padded members. However, this patent does not teach that the device is used for control of positioning of the rear knee, rather, it teaches weight change during the downswing. In addition, the disclosed device is large, requiring assembly and disassembly to be portable.

SUMMARY OF THE INVENTION

It is an object of the invention to provide a golf swing training device and method of training which provides a lightweight, completely portable device to fix the golfer's knee in the proper position at setup and maintain that correct position throughout the backswing.

In accordance with one embodiment of the invention, a golf swing training apparatus comprises a horizontal base unit formed of a sheet material; and a vertical rod affixed to the base unit, the rod having a height that extends to at least the location of a rear knee, of a person who is standing with at least a rear foot on the base unit with the rear foot located on the base unit rearwardly of the vertical rod, and the rear knee located forwardly of the vertical rod. In preferred embodiments, the vertical rod is supported by at least one brace extending from the vertical rod to the base unit, and most preferably, two braces at 90 degree angles to each other. Preferably, the base unit is provided with a marking identifying a location for placement of the person's rear foot, and has an anti-skid material affixed to a lower surface of the base unit. Preferably, the base unit is provided with a plurality of holes for receiving stabilizing pins therein. Conveniently, golf tees may be used as the stabilizing pins. Preferably, the vertical rod is removable from the base unit for storage of the golf swing training device. A method of golf swing training in accordance with the invention comprises placing a person's rear foot on the golf swing training device, adjacent to and rearwardly of the vertical rod; placing the person's rear knee adjacent to and forwardly of the vertical rod; the vertical rod maintaining positioning of the person's rear knee relative to the person's rear foot, preventing the rear knee from pointing in a direction oppositely from an intended direction of golf ball travel during a golf swing.

When the golfer places the rear foot on the base with the vertical rod at (or slightly behind) the ball of the foot on the inside of the foot and locks the outside of the kneecap of his rear knee on the vertical rod, the leg has the proper flex and position relative to the placement of the feet. As the golfer executes the backswing, the knee stays locked on the vertical rod. Limited rotation of the knee is permitted, but a roll away from the intended target or loss of the correct leg flex established at setup is prohibited. It is this restriction of any lateral motion in any direction and limited rotation of the knee that controls the lower body. It is the stable knee that keeps the hips from either over rotating and/or swaying laterally away from the intended target or target line.

Once a golfer is able to stabilize the lower body, any flaws in the rest of the swing can be identified and potentially corrected. However, until the lower body is stabilized, the inconsistency of the timing of the uncoiling of the hips, bottom of the swing and the position of the upper body at impact will prevent correct identification of other swing problems. Likewise, until the golfer can keep the hips from over rotating and sliding laterally away from the intended target and target line, power is lost and any consistency in ball flight accuracy is virtually impossible.

BRIEF DESCRIPTION OF THE DRAWINGS

Referring now to the drawings in which numbers indicate corresponding elements throughout the several views.

DETAILED DESCRIPTION OF THE PREFERRED EMBODIMENT

Figure 1:
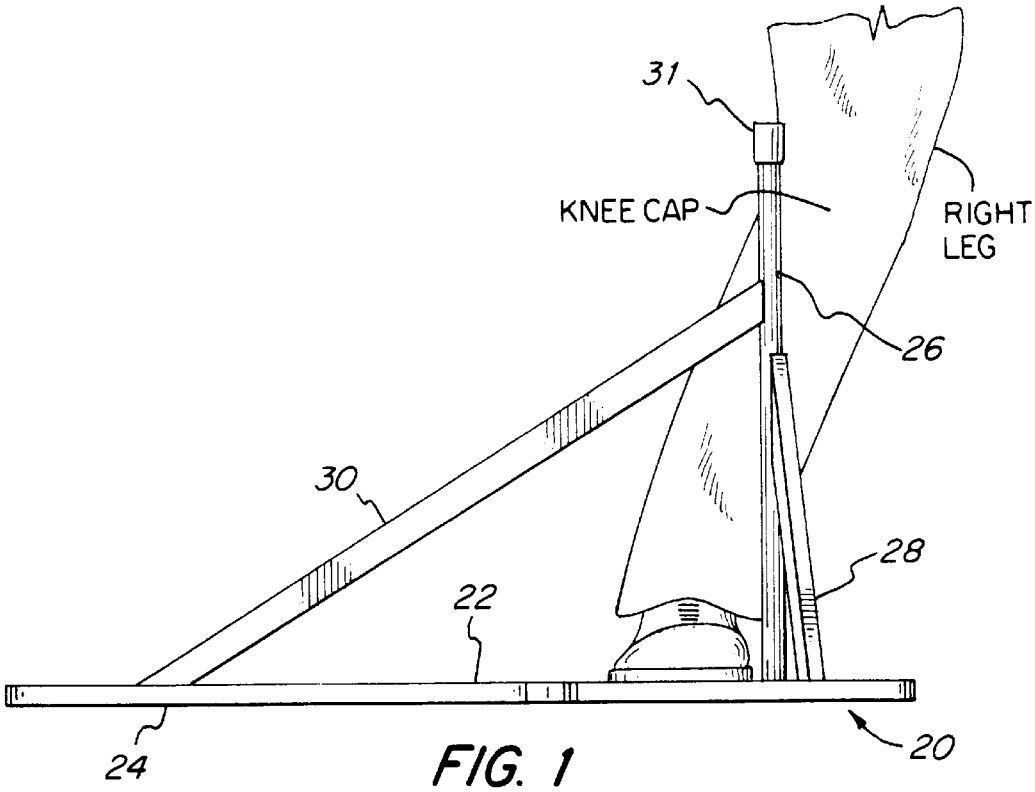
FIG. 1 is a front perspective of an embodiment of a golf swing training device in accordance with the present invention.
Figure 2:
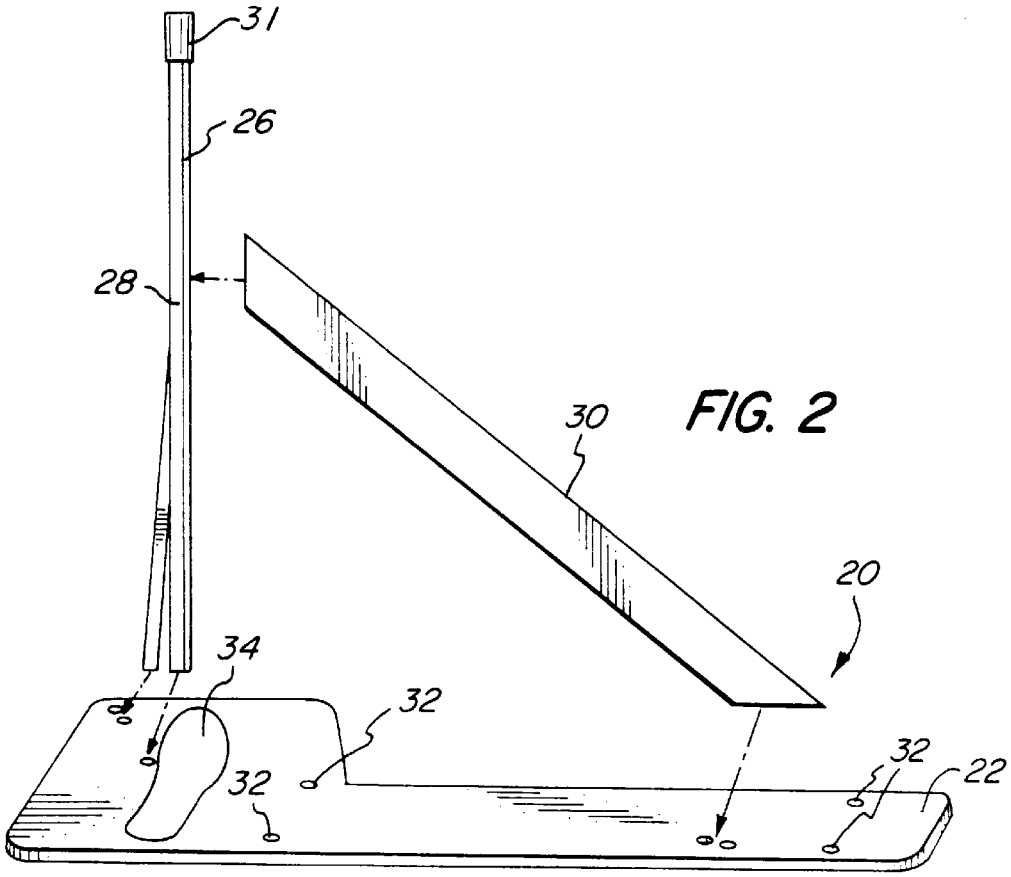
FIG. 2 is a rear exploded perspective of the embodiment of a golf swing training device of FIG. 1.

Referring now to FIGS. 1–2, an embodiment of a golf backswing training device 20 in accordance with the invention is shown. Device 20 has a base 22 with an anti-skid bottom surface 24. A vertical rod 26 is attached to base 22 at a 90° angle.

In the embodiment of the invention shown in the Figures, the base 22 and vertical rod 26 are constructed from wood or plastic materials to provide lightweight construction. However, such materials will typically require bracing of the vertical rod 26 to maintain structural integrity of the device. It is to be appreciated that the device may be constructed of other materials, including metal, which may eliminate the need for bracing supports for the vertical rod 26. The vertical rod 26 has a height at least equal to the location of a rear knee of a person standing with his foot on the base 22 adjacent vertical rod 26.

In FIGS. 1 and 2, a forward resistance brace 28 and a lateral resistance brace 30 are attached to the base 22. The braces are preferably at 90° angles to each other, and provide rigidity for the vertical rod 26 as the golfer turns against the vertical rod 26 during the backswing. In a preferred embodiment, the forward resistance brace 28 is permanently attached to the vertical rod 26. This assembly can be quickly removed and reattached to the base 22 using appropriate screws. The lateral resistance brace 30 similarly can be quickly removed and reattached to the base 22 and the vertical rod 26/forward resistance brace 28 assembly. The anti-skid surface 24 may be a high friction material which is permanently attached to base 22, or it may be a coating applied to the base 22. Preferably, vertical rod 26 is provided with a cap 31 to minimize inadvertent injury in a fall.

Holes 32 are provided in base 22 for using stabilizing pins (which may be golf tees 40 or other similar devices) to help position the device when used by the golfer in sand, on wet grass or other surfaces that might permit the base 22 to move during the backswing.

A foot placement outline 34 is preferably provided on the upper side of base 22. The outline 34 may be permanently applied as paint or may be a removable sticker or decal.

Figure 3B:
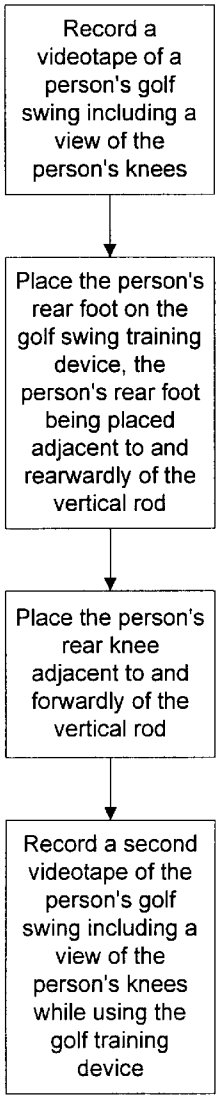
FIGS. 3*a* and 3*b* are flow diagrams of two methods of using the golf swing training device of FIG. 1.
Figure 3A:
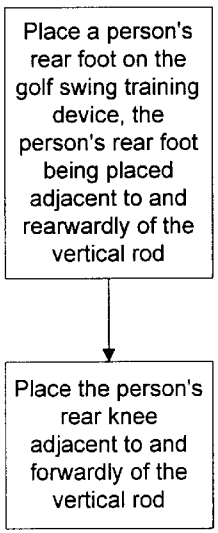

Referring to FIG. 3*a*, the device is used in the following way: the golfer places his rear foot on the base with the vertical rod at (or slightly behind) the ball of the foot on the inside of the foot and locks the outside of the kneecap of his rear knee on the vertical rod. At this point the leg has the proper flex and position relative to the placement of the feet. As the golfer executes the backswing, the knee stays locked on the vertical rod. Limited rotation of the knee is permitted, but a roll away from the intended target or loss of the correct leg flex established at setup is prohibited. It is this restriction of any lateral motion in any direction and limited rotation of the knee that controls the lower body. It is the stable knee that keeps the hips from either over rotating and/or swaying laterally away from the intended target or target line.

Referring to FIG. 3*b*, the invention may also be used in conjunction with video equipment to record the position of the golfer's body, including knee positioning during the golf swing. In such case, "before and after" videotapes showing the uncontrolled swing, and the controlled swing using the golf swing training device of the invention are made, allowing the golfer to observe the incorrect and correct knee positions, as an aid to training the golfer to maintain correct knee positions.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

I claim:

1. A method of golf swing training, comprising:

placing a person's rear foot on a golf swing training device, said golf swing training device having a horizontal base unit formed of a sheet material, and a rod affixed substantially perpendicular to said base unit, said rod having a height that extends to at least the location of a rear knee of a person who is standing with at least a rear foot on said base unit;

said person's rear foot being placed adjacent to and rearwardly of said rod so that said rod is located between said person's rear foot and forward foot;

placing said person's rear knee adjacent to and forwardly of said rod;

said rod maintaining the forward position of said person's rear knee relative to said person's rear foot and, preventing said rear knee from moving in a direction oppositely from an intended direction of golf ball travel during a golf swing.

2. A method of golf swing training as recited in claim 1, comprising:

the additional step of recording a videotape of a person's golf swing, including a view of the positioning of the person's knees during an uncontrolled golf swing;

recording a second videotape of said person's controlled golf swing using said golf swing training device, including a view of the positioning of the person's knees during said golf swing.

* * * * *